US005365901A

United States Patent [19]

Kiczek

[11] Patent Number: 5,365,901

[45] Date of Patent: Nov. 22, 1994

[54] LOW CREEP FLANGE AND ENGINE COVER ASSEMBLY

[75] Inventor: Casimir R. Kiczek, Northville, Mich.

[73] Assignee: Freudenberg-NOK General Partnership, Plymouth, Mich.

[21] Appl. No.: 151,831

[22] Filed: Nov. 15, 1993

[51] Int. Cl.[5] ..... F02F 7/00

[52] U.S. Cl. ..... 123/195 C; 123/90.38

[58] Field of Search ..... 123/90, 38, 195 C, 198 E

[56] References Cited

U.S. PATENT DOCUMENTS

| | | | |
|---|---|---|---|
| 2,529,616 | 11/1950 | Kraker | 123/90.38 |
| 3,090,463 | 5/1963 | Yanda | 123/195 C |
| 4,492,189 | 1/1985 | Ogawa et al. | 123/90.38 |
| 5,058,542 | 10/1991 | Grayson et al. | 123/90.38 |

FOREIGN PATENT DOCUMENTS

| | | | |
|---|---|---|---|
| 2275123 | 1/1976 | France | 123/195 C |

*Primary Examiner*—Noah P. Kamen

*Attorney, Agent, or Firm*—Dinnin & Dunn

[57] ABSTRACT

An engine cover assembly for use in an internal combustion engine. The engine cover includes a composite plastic body and low creep material for the flange section of the engine cover. The low creep material allows for a low incident of creep at the bolts which secure the engine cover to the head of the engine. This insures the bolts will not loosen due to the degradation of the material to which the bolt is tightened. A mechanical or chemical lock is used to secure the plastic cover to the low creep material flange portion of the engine cover, The engine cover reduces the weight and the engine noise associated with the internal combustion engine.

31 Claims, 3 Drawing Sheets

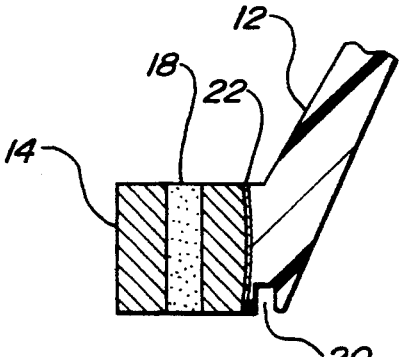
Fig-4
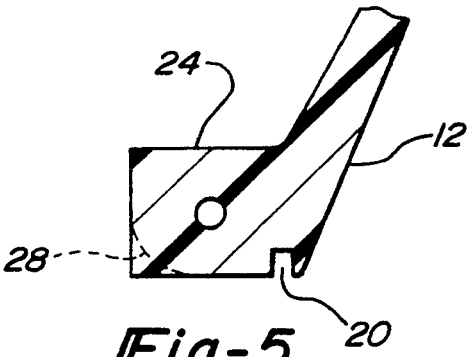
Fig-5
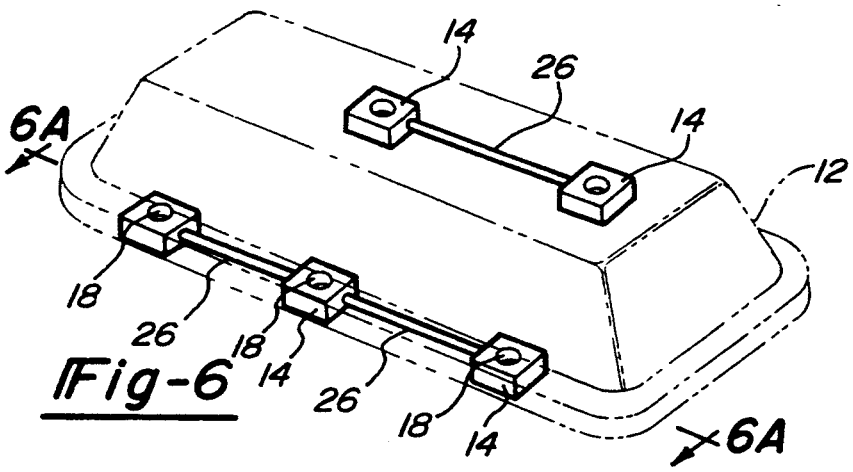
Fig-6
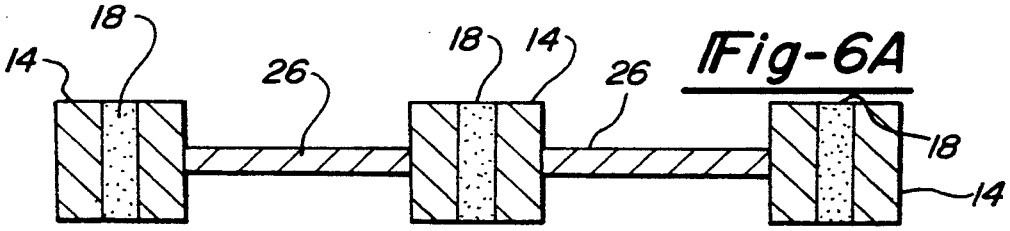
Fig-6A
Fig-7A
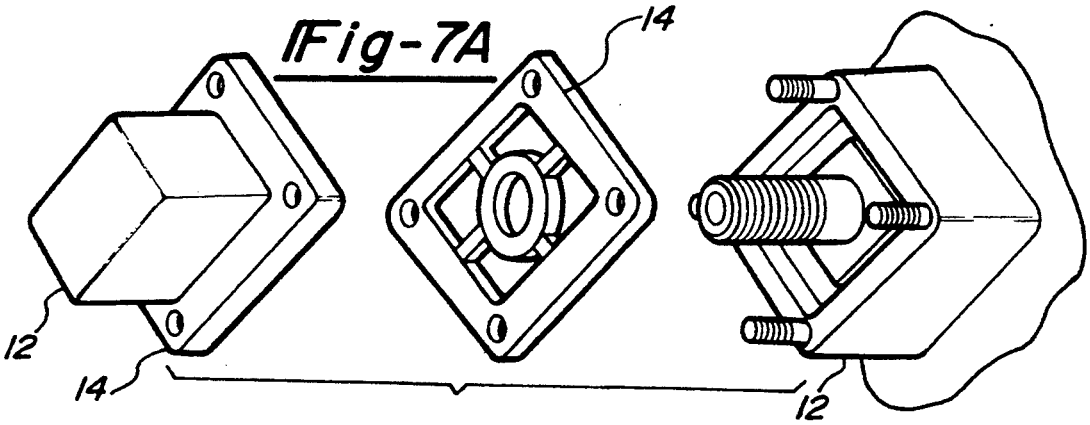

LOW CREEP FLANGE AND ENGINE COVER ASSEMBLY

BACKGROUND OF THE INVENTION

1. Field of the Invention

The present invention relates generally to cover assemblies and more particularly, to a novel engine cover assembly for an internal combustion engine.

2. Description of the Related Art

Cover assemblies for internal combustion engines have been used for many years. Typically the engine cover assembly is made of metal and is clamped by means of metal bolts to the engine block. The metal cover assembly does not attenuate noise well or conform to the movement of the engine block relative to the engine cover. Some metal engine covers may increase the weight of the automotive vehicle. However, any replacement part must be of the same strength in order to function properly in the automotive vehicles. Many plastic covers have been tried but they have had shortcomings due to material creep strength and difficulties in staying securely fastened to the engine block. Plastic tends to have a high creep value which allows the bolt head to indent or make impressions into the plastic or the flange bow thus reducing the clamp load on the gasket sandwiched between the engine cover and the engine block.

Other types of covers have also been tried, for example a plastic cover has been formed to a metal type seal surface and then placed onto the engine head. However this type of cover does not allow any flexibility between the plastic and the metal. The plastic and metal seam becomes brittle which causes oil leaks. Thus, there has been a need in the art for a lightweight and high damping capacity engine cover for use in an internal combustion engine. The flange cover needs to have low creep characteristics so that it can be securely bolted to the engine block with no worry of creep.

SUMMARY OF THE INVENTION

One object of this invention is to provide a novel engine cover which is lightweight and which also functions to reduce engine noise.

It is another object of the present invention to provide an engine cover which has a low creep material flange with a composite plastic encapsulating cover.

Another object of the present invention is to provide an engine cover which is able to move relative to the movement of the engine block yet provide a seal between the engine cover and the engine head or block.

Other objects, features and advantages of the present invention will be readily appreciated as the same becomes better understood after reading the following description taken in conjunction with the accompanying drawings.

To achieve the foregoing objects, the engine cover includes a cover body which is made from a plastic material, and a flange section which meets with the engine head or block for secure fastening of the engine cover to the engine head or block. The flange includes a projection which projects towards the composite plastic cover material with an appendage and securely fastens itself to the encapsulating cover. A peripheral groove is located along the bottom edge of the plastic cover, and a seal is inserted into the groove which is sandwiched between the engine cover and the engine head or block. The encapsulating plastic cover is molded to the metal flange surface area.

One advantage of the engine cover is that the flange and plastic cover are lighter in weight than an all metal cover. Another advantage of the engine cover is that the noise attenuation of the flange and plastic cover is better than an all metal cover.

BRIEF DESCRIPTION OF THE DRAWINGS

FIG. 4 is a cross-sectional view of an alternate construction of the flange and cover body joint taken along the line 4—4 in FIG. 1.

FIG. 5 is a cross-sectional view of the plastic cover body of the present invention showing an alternate embodiment.

FIG. 6 is a view of an alternate embodiment of the engine cover assembly.

FIG. 6A is a view of a metal flange and rod mechanism which can also be used to allow for relative movement of the plastic cover with the metal flange.

FIG. 7A is a view of an alternate embodiment of the engine cover assembly.

FIG. 8 is a view of an alternate embodiment showing a tappet cover or the like.

DESCRIPTION OF THE BEST MODE AND PREFERRED EMBODIMENTS

Figure 1:
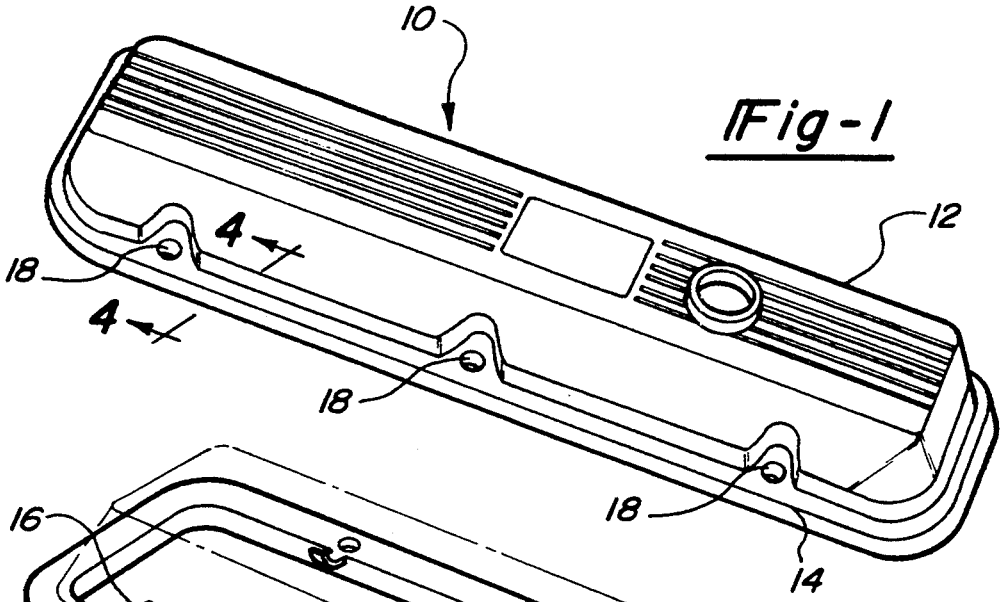
FIG. 1 is a view of an engine cover assembly according to the present invention.

Referring now to FIG. 1, an engine cover 10 is shown according to the present invention. The engine cover 10 includes the plastic encapsulating cover body 12 and the flange 14 which connects to the engine head or block (not shown). The flange 14 also includes a plurality of bolt holes 18 for securely fastening the engine cover 10 to the engine head or block. The bolt holes 18 are set at a predetermined distance around the engine cover 10 to provide sufficient clamp load to the gasket so as to seal completely around the engine cover 10. The material surrounding the bolt holes 18 and flange 14 are made of a material which has low material creep characteristics.

The clamp load is a function of flange pressure. It is the single most important factor in controlling the success or failure of a gasketed joint. By establishing sufficient flange pressure, the gasket is able to seal the flanged joint.

When bolts are tightened, they elongate or stretch. From the stress-strain relationship for a bolt, the bolt load is determined as well as the compressive stresses on the flange and gasket. With time, the compressive stresses on the gasket and flange will cause the flange material and gasket material to creep. Creep is a transient stress-strain condition in which the strain increases as the stress remains constant. This condition is approached in flat-face gasketing joints in which the bolts undergo high elongation. In other gasketing joints, the stress will decrease as the flange material creeps under the bolt head and the gasket material creeps. Assuming that there is sufficient flange pressure to seal the joint, clamp load must be greater than the flange material creep plus the gasket material creep to produce a long term leak free joint.

In applications where functional long life are required, such as automobiles, engines, aircraft, stationary power plants, agricultural vehicles, industrial applications, construction vehicles and trucks, the entire cover system must be designed to provide sufficient bolt elongation over time with low flange material creep and low gasket material creep with sufficient rebound force in the gasket to maintain sealing so as to produce a leak free, low noise encapsulating cover.

The cover body 12 is preferably made from a plastic composite material, such as Nylon 66 or Nylon 46, however other materials such as phenolic, polyester, or vinyl ester which are thermosetting plastics; or a thermoplastic material such as polyether sulphone, polyphthalamide, polyarylate, polycarbonate, polyphenylene sulfide, polyester, polyethylene terephthalate, polyamide, polyimide, or the like may be used, and the plastic material may be reinforced with glass fibers, or minerals. Other materials may also be used to make the cover body 12 of the engine cover 10 such as polymers of: polyurethane, nylon, acetel, polycarbonate or other suitable thermoset or thermoplastic materials. The cover body 12 of the engine cover 10 will reduce the weight of the overall engine and reduce the engine noise due to the fact that plastic materials have a natural frequency approximately 30 to 60% lower than metals used in the same type of application. Also, the specific bending strengths of plastics is much greater than that of cold rolled steel plate and is approximately the same or slightly better than aluminum die cast or magnesium alloy cast parts. The noise reduction is greater due to the cover stiffness being lower. The stiffness found in composite plastic covers gives the greater noise level reductions in the 700 to 2800 Hz range. This range occurs where the structural vibration levels of the engine cylinder head are high. This in turn lowers the natural frequency modes within the excitation frequency range and thus produces noise level reductions. The plastic material is also easier to mold into the required shape for an engine cover 10.

A low creep material flange 14 (made of a material such as aluminum, steel, cast iron, phenolic, polyether sulfone, etc.) should be used in conjunction with the plastic cover body 12, because the plastic cover body 12 has very high creep characteristics. The plastic would tend to creep, make indentations or Brinell when a bolt is applied to it for a long period of time at high temperatures. Brinelling would cause a reduction in the clamp load to the gasket or seal, thus causing oil leaks and other engine problems. Therefore, a low creep material flange 14 can be used where the engine cover 10 is physically connected, by suitable fasteners, to the engine head or block in order to reduce potential leaks by decreasing the potential of losing substantial clamp load. The low creep material flange 14 is securely fastened to the engine head or block by means of threaded fasteners. In this embodiment, the low creep material flange 14 forms the area along the outer rim of the engine cover 10 which interfaces with the mating surface of the head of the engine. However, the low creep material flange 14 may be located around the apertures only, for example, by an "L" shaped segment with a bolt hole therethrough. The low creep material flange 14 includes a plurality of vertical apertures 18 which permit fasteners to connect the engine cover 10 to the head of the engine.

The low creep material flange 14 may be a flat planar sectional shape or square with a bolt hole 18 through the center portion of the top surface. The engine cover 10 has an overall rectangular shape with rounded corners. The plastic cover body 12 is shaped so as to meet an appendage or projection in the side of the low creep material flange 14. The outer plastic cover body wall connects the low creep material flange 14 and the top surface of the cover body 12 as does the inside plastic cover body wall after a short horizontal edge.

Due to the relative movement of the engine block during operation of the engine, a mechanical lock or a chemical lock is desired between the plastic cover body 12 and the low creep material flange 14. A chemical lock is used by applying a suitable bonding agent between the plastic body 12 and the low creep material flange 14. This will cause a chemical reaction between the plastic cover body 12 and low creep material flange 14. The reaction will seal and securely fasten the plastic cover body 12 to the low creep material flange 14 ensuring no leak path at the interface between them.

Another embodiment (not shown) has the plastic cover body 12 being molded directly to the low creep material flange 14 (i.e. aluminum, steel, cast iron, phenolic, polyether sulfone, etc.). The effect of the molding process will securely fasten the low creep material flange 14 to the plastic cover body 12 also giving a secure, leak free seal between the plastic cover body 12 and the low creep material flange 14.

Figure 2:
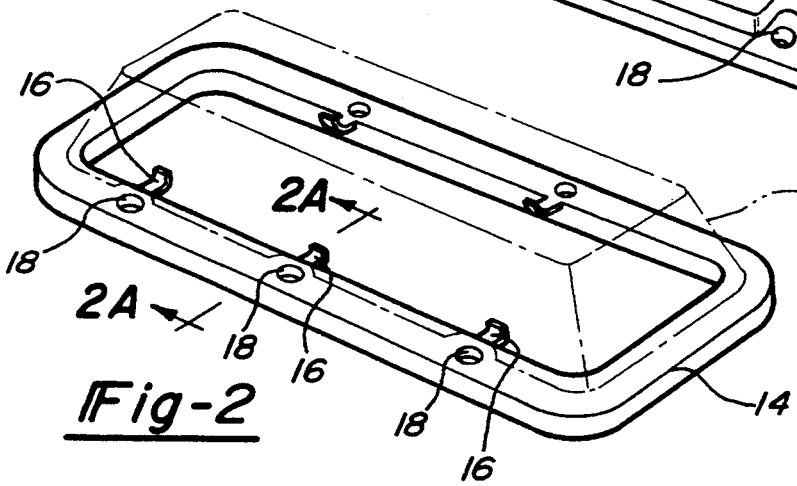
FIG. 2 is a view of an engine cover assembly.
Figure 2A:
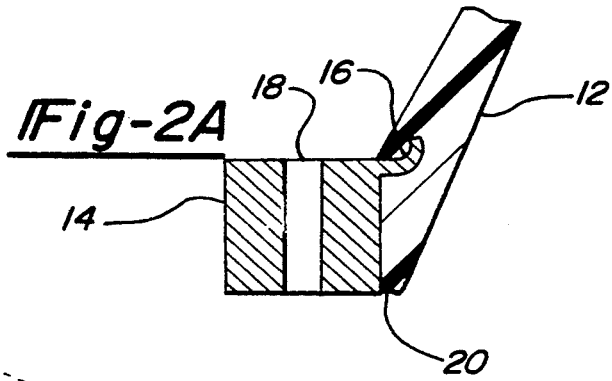
FIG. 2A is a cross-sectional view of the flange and cover body joint taken along line 2A—2A in FIG. 2.
Figure 3:
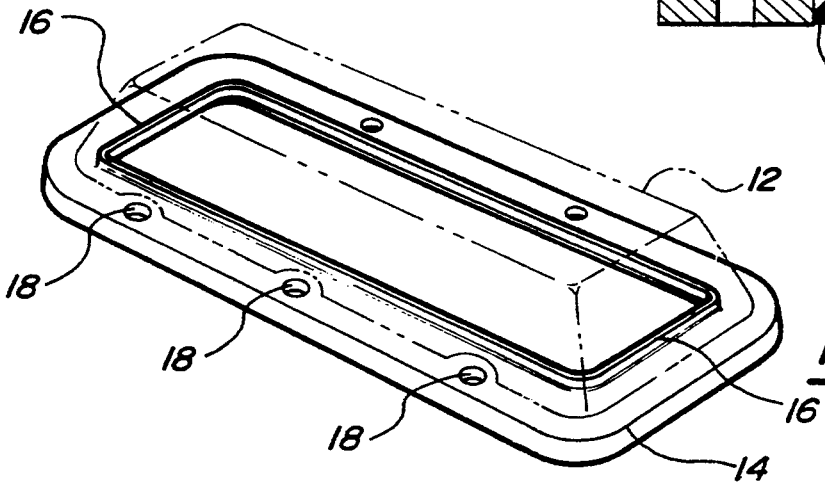
FIG. 3 is a view of the engine cover assembly.

A mechanical lock embodiment, see FIG. 2, ensures that the plastic cover body 12 and flange 14 will bond together. The mechanical lock embodiment includes a projection or appendage 16, which is made of metal or another low creep material, which protrudes from a metal or low creep material flange 14 and is physically molded into the plastic cover body 12 in a key lock fashion so as to securely fasten the plastic cover body 12 no the metal or low creep material flange 14. In this embodiment the projection 16 projects from the top edge of the metal or low creep material flange 14 and approximately has the shape of an L. The L-shape is pointing towards the cover body 12 and is molded directly into the plastic cover body 12. The projection 16 may run continuously along the entire low creep material flange 14 or may be located at the portion of the low creep material flange 14 which surrounds the bolt hole 18. This will assure an adequate bond which will not loosen under normal engine conditions.

The plastic cover body 12 also has at the bottom edge a peripheral groove 20 which is shaped as a rectangle or square for use in holding an elastomeric seal which is sandwiched between the engine cover 10 and the head of the engine. The seal groove 20 runs continuously along the entire inside bottom edge of the plastic cover body 12.

Figure 7:
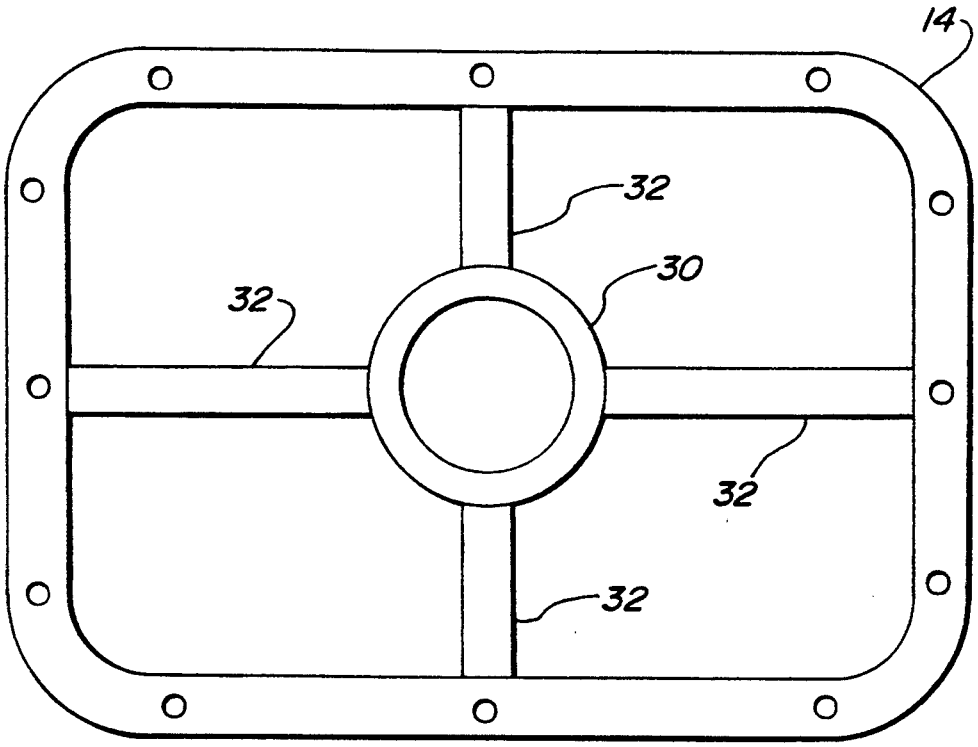
FIG. 7 is a view of an alternate embodiment showing the shaft seal support and the supporting straps.

Another embodiment of the present invention, see FIG. 7, includes a metal support 30 for a shaft seal which is connected by straps 32 to the sheet metal flange 14 of the engine cover 10. The four straps 32 can be made of a metal material or a plastic material. The four straps 32 will hold a shaft seal in a proper position. The shaft seal will be properly located so that the shaft will slide into it upon installation of the engine cover 10. The body of the engine cover 10 is made of a composite plastic or other suitable low creep material. This engine cover 10 will also be lightweight and attenuate noise better than an all metal cover.

Another embodiment of the invention includes a low creep material (i.e. aluminum, steel, cast iron, phenolic, polyether sulfone etc.) flange 14 which has a hinge portion connected to the plastic cover body 12, see FIG. 4, FIG. 5 and FIG. 6. The encapsulating cover 10 in this embodiment is completely made from the composite plastic material which may include fiberglass reinforcement except for the low creep material flange 14 areas. The plurality of bolt holes 18 are formed in the low creep material flange 14. The flange has a hole 18 vertically down the middle of a cube or cylinders for which the bolt is able to pass through into the engine head or block. The cubes or cylinders are also connected via the midpoint of a sidewall by a low creep material rod 26.

This one piece low creep material flange 14 and rod assembly 26 is then molded onto the plastic cover body 12. The plastic cover body 12 is molded to the side of the low creep material flanges 14 and around the low creep material rods 26. The plastic cover body 12 has a rounded surface which engages the low creep material flange 14, the low creep material flange 14 also has a similar rounded surface on the inner edge of its cube. This rounded edge will allow for movement between the low creep material flange 14 and the plastic cover body 12. The plastic cover body 12 also has a rounded edge 28 on the bottom outside corner which will rotate on the head of the engine to compensate for any relative movement of the plastic cover body 12. The flange edge will be able to keep a tight seal with the engine head or block due to its ability to rotate. The plastic cover body 12 also has a peripheral seal groove 20 which holds a seal for fastening the engine cover 10 to the head of the engine so as to prevent leakage of fluid.

Referring to the cross section of the plastic cover body 12, see FIG. 5 and FIG. 6A, the plastic cover body 12 surrounds the rod 26 and has preferably a cylindrical shape although it is also possible to have a square shape with a rounded edge 28 on the bottom outside corner. The plastic cover body 12 then ascends to the top of the engine cover 10. The connection between the low creep material flange 14 and plastic cover body 12 is molded so that relative movement may occur, it is not necessary to have a chemical lock between the flange 14 and the plastic cover material on the hinged designed. The hinged design may be made in one of two ways. The first is where the hinged low creep material flange is only located on one side of the engine cover 10 and the remainder of the flange is made of low creep material. The second is where the hinged low creep material flange runs continuously around the engine cover 10.

Figure 8:
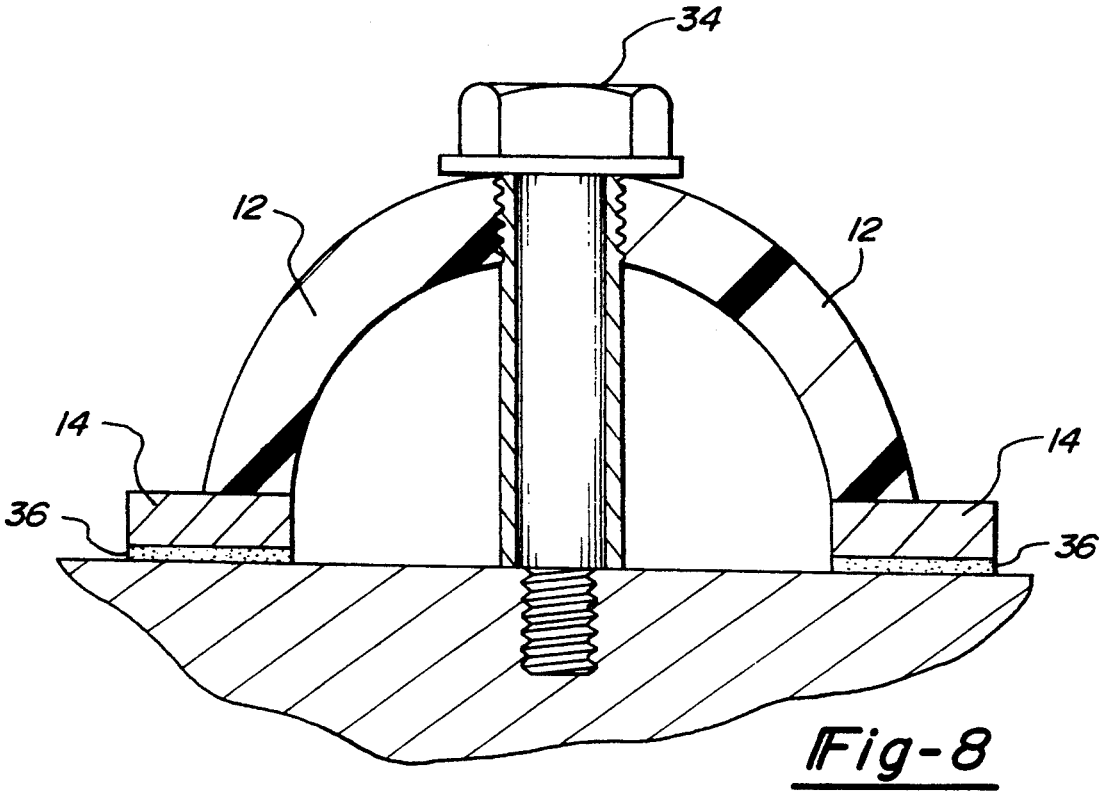

Another embodiment of the present invention may be used with tappet covers for example, see FIG. 8. In this embodiment the low creep material (i.e. aluminum, steel, cast iron, phenolic, polyether sulfone etc.) flange 14 interfaces with a plastic material cover body 12. At the apex of the plastic cover body 12 is an aperture for receiving a fastener 34. A sleeve 38 is placed within the aperture to guide the fastener 34. The fastener 34 is placed through the aperture and sleeve into the head of the engine. A gasket 36 may run continuously across and along the entire length of the low creep material flange 14. A metal reinforcing member may also run entirely along the inner portion of the plastic cover body 12. This embodiment will also prevent fluid from leaking out of the fluid containing chamber while reducing the overall weight of the engine.

Another embodiment of the present invention may also be used in a two cover and gasket arrangement (see FIG. 7A). This would occur for example at the front cover where the water pump connects to the engine. The water pump would have a metal or low creep material flange. The water pump body would be made of a composite plastic material and interface with the low creep flange for a low leak boundary. A front cover would also have a metal or low creep material flange and a cover body made of a composite plastic material. The front cover flange and cover body would also interface for a low leak boundary. The front cover would have a peripheral seal groove run continuously on both sides of the metal flange. The water pump would also have a peripheral seal groove run continuously along its low creep material flange. A gasket would be placed in the groove along the flange of the water pump and then connected to the flange of the front cover. The gasket would be sandwiched between the flange of the water pump and the front cover. The front cover and water pump would then be fastened to the engine block with a gasket placed in the second groove of the front cover to ensure no leaks at the engine block interface.

The above engine covers may also have applications for engines, transmissions, axles and any powertrain component that requires fluid encapsulation. The cover will work in a number of structural member situations such as, a front engine cover, oil pan, valve cover, rear seal retainer cover, thermostat housing cover and tappet cover. It may also be used on the transmission in the following situations as a side cover, a main control cover, a bottom pan and a power take off side cover.

However, all of the designs mentioned above will reduce the engine noise because the natural frequency of the flange 14 and plastic body cover 12 will be lower than that of an all metal cover. The design also allows for the engine cover 10 to be securely fastened to the engine head via the low creep material flanges 14 and fasteners. It should be noted that the preferred embodiment plastic cover body 12 could alternatively be made from other materials such as polyacrylate, ethylene acrylic or silicone elastomers as long as a continuous low creep material flange 14 is employed with these alternative embodiments.

An engine cover 10 of composite plastic was used. This will in turn reduce any wear and tear on the engine and prevent any abnormal leaks.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. An engine cover assembly for use on an engine head or block in an internal combustion engine, comprising:

a cover body made of a composite plastic material which is lighter in weight and has a greater noise damping effect than metal;

a flange made of a low creep material that is connected to said cover body said flange generally having a square cross-section; and a groove along the bottom edge of said plastic cover for inserting a seal to engage with the surface of the engine head or block.

2. An engine cover assembly of claim 1 wherein said flange is metal and includes a plurality of apertures.

3. An engine cover assembly of claim 2 wherein said flange includes a projection which projects towards the cover body, said projection located at the top edge of the inner side of said flange for locking said flange to said cover body.

4. An engine cover assembly of claim 3 wherein said projection is continuous along the entire said flange.

5. An engine cover assembly of claim 3 wherein said projection is located only at the said apertures.

6. An engine cover assembly of claim 3 wherein said projection is generally L-shaped in cross-section.

7. An engine cover assembly of claim 1 wherein said connection between said flange and said cover body is made with an epoxy material.

8. An engine cover assembly for use on an engine head or block in an internal combustion engine, comprising:

a cover body made of a composite plastic material which is lighter in weight and has a greater noise damping effect than metal;

a flange made of a low creep material that is connected to said cover body;

a groove along the bottom edge of said plastic cover for inserting a seal to engage with the surface of the engine head or block; and said flange includes a plurality of cube like members connected by a rod, said rod being connected at the center of at least one side of each of said plurality of cube members, said rod having said composite plastic completely encapsulating said rod, said cover body being able to rotate about said rod to compensate for engine movement.

9. An engine cover assembly of claim 8 wherein said cover body and said flange connection is made by form injection.

10. An engine cover assembly for use on an engine head or block in an internal combustion engine, comprising:

a cover body made of a composite plastic material which is lighter in weight and has a greater noise damping effect than metal;

a flange made of a low creep material that is connected to said cover body;

said flange includes a plurality of straps and a circular support member connected to said straps; and a groove along the bottom edge of said plastic cover for inserting a seal to engage with the surface of the engine head or block.

11. An engine cover assembly of claim 10 wherein said circular support member is placed in a predetermined position with said straps.

12. An engine cover assembly for use on an engine head or block in an internal combustion engine, comprising:

a cover body made of a composite plastic material which is lighter in weight and has a greater noise damping effect than metal; said cover body includes an orifice at an apex of said cover body, said orifice includes a sleeve which extends to the engine head or block;

a flange made of a low creep material that is connected to said cover body; and a groove along the bottom edge of said plastic cover for inserting a seal to engage with the surface of the engine head or block.

13. An engine cover assembly for use on an engine head or block in an internal combustion engine, comprising:

a cover body made of a composite plastic material which is lighter in weight and has a greater noise damping effect than metal;

a flange made of a low creep material that is connected to said cover body;

a groove along the bottom edge of said plastic cover for inserting a seal to engage with the surface of the engine head or block: and a second cover mounted to said flange.

14. An engine cover assembly for use on an engine head or block in an internal combustion engine, comprising:

a cover body made of a composite plastic material which is lighter in weight axed has a greater damping effect than metal;

a flange made of a low creep material, said flange includes a rod, said flange having a plurality of generally cube shaped members with a circular orifice through the top and bottom surfaces of said cube members, said rod connecting said plurality of cube shaped members, said circular orifice for securing said cover to the engine;

said plastic cover body is formed around said rod thus allowing for a torquing motion between the engine cover and the engine block; and a seal groove along the bottom edge of said cover for sealing the engine cover to the engine.

15. An engine cover assembly of claim 14 wherein said flange is metal.

16. An engine cover assembly for use on an engine head and block in an internal combustion engine, comprising:

a flange made of a low creep material which will be used to connect the engine cover assembly to the engine block, said flange generally having a square cross-section, said flange includes a projection which is generally L-shaped in cross-section and protrudes from the top inside edge of said flange;

an engine cover body made of a composite plastic material having damping capacity, said engine cover body is formed to said flange inner surface and over said projection in order to make a lightweight engine cover; and a groove along the bottom inside edge of said engine cover body for a seal to engage the engine cover assembly with the surface of the engine block.

17. An engine cover assembly of claim 16 wherein said projection will act as a mechanical lock.

18. An engine cover assembly of claim 16 wherein said flange has a plurality of holes for use in securing the engine cover to the engine block.

19. An engine cover assembly of claim 16 wherein said flange and said cover body are joined with a chemical compound.

20. An engine cover assembly of claim 16 wherein said flange is metal.

21. An engine cover assembly for use on an engine head and block in an internal combustion engine, comprising:

a flange made of a low creep material which will be used to connect the engine cover assembly to the engine block, said flange having a circular low creep material rod connecting a plurality of cube shaped members surrounding a plurality of bolt holes;

an engine cover body made of a composite plastic material having damping capacity, said engine cover body being formed around the said rod of said flange so that a torquing motion can occur, said engine cover body being able to slide against the surface of said flange in order to compensate for movement of the engine during operation; and a groove along the bottom inside edge of said engine cover body for a seal to engage the engine cover assembly with a surface of the engine block.

22. An engine cover assembly of claim 21 wherein said low creep material is metal.

23. A powertrain cover for enclosing fluids therein, said cover comprising:

a flange member having a peripheral portion for mounting to the powertrain and an appendage extending from said peripheral portion;

a cover body having an outer surface portion contiguous to said flange member, and means for attaching said cover body having an outer surface portion to said flange member so that said appendage is secured to said cover body while permitting said cover body to move relative to said flange member.

24. A powertrain cover as claimed in claim 23 wherein said cover body having an outer surface portion further includes a peripheral groove and further comprising:

a seal inserted into said peripheral groove so as to prevent fluid leakage.

25. A powertrain cover as claimed in claim 24 wherein said flange member further including portions defining at least one aperture.

26. A powertrain cover as claimed in claim 24 wherein the powertrain has portions defining holes and further comprising:

a second cover mounted to said flange; and a fastener clamping said cover to said flange and engaging the holes in the powertrain.

27. A powertrain cover as claimed in claim 23 wherein said attaching means further includes:

a mechanical lock for locking said cover body to said flange member.

28. A powertrain cover as claimed in claim 23 wherein said attaching means further includes:

a hinged member on said flange member to connect to said cover body.

29. A powertrain cover as claimed in claim 28 wherein, said hinged member has a cylindrical portion and a rod portion extending from said cylindrical portion.

30. A powertrain cover as claimed in claim 27 wherein, said mechanical lock having an L-shaped portion.

31. A powertrain cover as claimed in claim 30 wherein, said mechanical lock extends circumferentially in spaced relationship to said flange member.

* * * * *